US006629940B2

(12) United States Patent
Shimizu

(10) Patent No.: US 6,629,940 B2
(45) Date of Patent: Oct. 7, 2003

(54) LOWER LEG MASSAGER AND CHAIR TYPE MASSAGING APPARATUS USING THE SAME

(75) Inventor: Nobuzo Shimizu, Higashi-Osaka (JP)

(73) Assignee: Daito Electric Machine Industry Company, Limited, Osaka (JP)

( * ) Notice: Subject to any disclaimer, the term of this patent is extended or adjusted under 35 U.S.C. 154(b) by 0 days.

(21) Appl. No.: 09/958,033

(22) PCT Filed: Mar. 21, 2001

(86) PCT No.: PCT/JP01/02268

§ 371 (c)(1),
(2), (4) Date: Oct. 3, 2001

(87) PCT Pub. No.: WO01/76527

PCT Pub. Date: Oct. 18, 2001

(65) Prior Publication Data

US 2002/0161316 A1 Oct. 31, 2002

(30) Foreign Application Priority Data

Apr. 6, 2000 (JP) ..... 2000-105143

(51) Int. Cl.[7] ..... A61H 7/00
(52) U.S. Cl. ..... 601/133; 601/97; 601/101
(58) Field of Search ..... 601/133, 89–93, 601/97–99, 101–104, 27, 33–35, 112, 115

(56) References Cited

U.S. PATENT DOCUMENTS

| | | | | |
|---|---|---|---|---|
| 4,505,267 A | * | 3/1985 | Inada | 601/94 |
| 5,843,006 A | * | 12/1998 | Phillips et al. | 601/133 |
| 6,190,339 B1 | * | 2/2001 | Imazaike et al. | 601/133 |
| 6,213,962 B1 | * | 4/2001 | Shimizu | 601/90 |

FOREIGN PATENT DOCUMENTS

| | | | |
|---|---|---|---|
| JP | 5086889 A | | 7/1975 |
| JP | 08089540 A | | 4/1996 |
| JP | 10118143 A | | 5/1998 |
| JP | 11347082 A | | 12/1999 |
| JP | 02000084021 | * | 3/2000 |

* cited by examiner

*Primary Examiner*—Justine R. Yu
(74) *Attorney, Agent, or Firm*—Birch, Stewart, Kolasch & Birch, LLP

(57) ABSTRACT

A lower leg massager is constructed in such a manner that the lower leg can be massaged over a wide range without arranging a plurality of massaging members along the length thereof. Right and left massaging members formed of elongated boards are arranged in an opposed manner so a lower leg can be fit therebetween. A driving mechanism is provided for moving the massaging members toward and away from each other so that the longitudinal directions thereof are inclined in opposite directions with respect to each other, and changing the extent of longitudinal inclination when moving the massaging members toward and away from each other.

15 Claims, 9 Drawing Sheets

LOWER LEG MASSAGER AND CHAIR TYPE MASSAGING APPARATUS USING THE SAME

This application is the national phase under 35 U.S.C. §371 of PCT International Application No. PCT/JP01/02268 which has an International filing date of Mar. 21, 2001, which designated the United States of America and was not published in English.

TECHNICAL FIELD

The present invention relates to a lower leg massager and a chair type massaging apparatus using the same.

BACKGROUND ART

Hitherto, one of chair type massaging apparatuses that can massage not only the back or the hip of the human body, but also lower legs (specifically, the portion from below knee region to the vicinity of the ankle) thereof is disclosed in, for example, Japanese Patent Publication No.3012780. This massaging apparatus, comprises a seat portion for supporting the hip of the human body from below, a seatback portion provided at the rear end of the seat portion and including a massaging mechanism therein, and a footrest connected to the front end of the seat portion and having capability of massaging lower legs.

Such a footrest comprises a pair of right and left therapeutic recesses for accommodating lower legs between both end walls and center wall, and airbags on the inner surfaces of both side walls and on both side surfaces of the center wall. Therefore, in the footrest of the related art, both lower legs fitted in the respective therapeutic recesses can be massaged simultaneously by inflating and deflating the respective air bags by an air supplying/discharging apparatus.

In the case of an airbag used in the footrest described above, since the swelling extent thereof is the largest at the center and gradually decreases toward both ends, a sufficient pressing force is applied only on a small region along the length of the lower leg, and thus in order to obtain a desired massaging effect, the user disadvantageously have to move his/her lower legs along the therapeutic recesses.

Therefore, as disclosed in Japanese Unexamined Patent Publication No. HEI 11-347082, a footrest having a plurality of airbags adjacently aligned along the length of each therapeutic recess to supply and discharge air to/from the plurality of airbags simultaneously or sequentially so that the lower leg can be effectively massaged over a large region along the length thereof has already been proposed.

However, such a massaging apparatus has a disadvantage in that the number of components increases and thus the manufacturing cost increases as well since a plurality of airbags (massaging members) have to be aligned along the length of the recess on both sides of one therapeutic recess.

Moreover, in addition to the fact that the airbag type massaging apparatus has a disadvantage in that it is large and costly since an air supplying/discharging apparatus comprising a compressor, an air piping, an electromagnetic valve, and a controlling means for the valve is required, there is another disadvantage in that programming of the controlling means for the air supplying/discharging apparatus increases in complexity in order to inflate and deflate the plurality of airbags simultaneously and sequentially, thereby further increasing the manufacturing cost.

On the other hand, a conceivable measure to solve the fundamental disadvantage existing in such an airbag type massaging apparatus is to employ a mechanism that both side wall that constitute the therapeutic recess themselves moves toward and away from the lower leg.

However, when allowing the both side walls constituting the therapeutic recess to move simply in parallel toward and away from the lower leg, the both side walls press only the thicker portion of the lower leg (for example, the calf), and the thinner portion (for example, the portion near the ankle) cannot be preferably massaged. In addition, the simple parallel movement of the both side walls cannot perform complex massaging operation such as rubbing up and rubbing down for the lower leg.

With such circumstances in view, it is an object of the present invention to provide a massager being capable of massaging the lower leg over a wide range and in a preferred manner at low cost by constructing the apparatus in such a manner that the lower leg can be pressed over a wide range without arranging a plurality of massaging member along the length thereof.

DISCLOSURE OF INVENTION

In order to achieve the object described above, the present invention takes a following technical step.

That is, the lower leg massager according to the present invention comprises: massaging means comprising a pair of right and left massaging members arranged in an opposed manner at a space as wide as a lower leg can be fitted therebetween and formed of board elongated in the direction along the length of the lower leg; and driving means for moving the pair of right and left massaging members toward and away from each other so that the longitudinal directions thereof are inclined in the opposite directions with respect to each other and changing the extent of longitudinal inclination of the massaging members with respect to the longitudinal direction of the lower leg when moving the massaging members toward and away from each other.

In this case, when the driving means is operated with a lower leg fitted between the pair of right and left massaging members, the respective massaging members move toward and away from each other so that the longitudinal directions thereof are inclined in the opposite directions with respect to each other for massaging the lower leg fitted therebetween.

In the present invention, since the massaging member is constructed not only to simply moves in parallel but also to change the extent of longitudinal inclination thereof with respect to the direction longitudinally of the lower leg when they moves toward and away from each other, the massaging members adequately presses each longitudinal portions of the lower leg of different thickness. Therefore, the lower leg can adequately be massaged over a wide range along the length thereof even without arranging a plurality of massaging members along the direction longitudinally of the length of the lower leg.

When each massaging member moves toward and away from each other, the extent of longitudinal inclination of each massaging member with respect to the direction longitudinally of the lower leg changes, and thus complex massaging operation such as rubbing up and rubbing down can be performed for the lower leg.

In the invention described above, by constructing a pair of right and left massaging members to be driven by the driving means in such a manner that when one of the longitudinally opposing ends of the pair of right and left massaging members moves toward each other, the other longitudinally opposing ends thereof move away from each other, and when one of the longitudinally opposing ends of the pair of right and left massaging members move away from each other, the other longitudinally opposing ends of the pair of right and left massaging members move toward each other, the different therapeutic portions of the lower leg longitudinally away from each other can be massaged alternately at different timings, and thus the massaging effect for the lower leg can be improved.

In addition, by constructing the pair of right and left massaging members in such a manner that the extent of widthwise inclination of the same massaging member with respect to the thickness of the lower leg is changed when they moves toward and away from each other by the driving means, the complex massaging operation such as rubbing up and rubbing down with respect to the lower leg can also be performed in the direction of thickness thereof.

The driving means that can be employed for performing the above-described operation may comprise, more specifically, a revolving shaft passing through each massaging member in the direction of thickness so as to be capable of relative rotation with respect to the pair of right and left massaging members, a pair of right and left cam members fixed at axially intermediate positions of the revolving shaft and having cam surfaces inclined with respect to the revolving shaft and abutted against each massaging member, and a guide member for allowing the pair of right and left massaging members to move along the revolving shaft but restricting the same from being rotated therewith.

In this invention, by arranging two massaging means in such a manner that the therapeutic recesses for the lower legs constructed by the massaging members of the same means are arranged side by side in the same direction on the left side and the right side away from each other, two massaging means can massage a pair of lower legs at the same time. In this case, by providing the driving motor for rotating the revolving shaft between these two massaging means, the lateral dimension of this massaging apparatus can be reduced.

In the present invention, forming the pair of right and left massaging members of leaf springs that are resiliently deformable in the direction of thickness prevents the massaging members from pressing the lower leg too strong and making the user feel pain.

In the present invention, by constructing the pair of right and left massaging members in such a manner that the portion corresponding to the lower portion of the lower leg to be fitted therebetween is moved closer to the lower leg in comparison with the: portion corresponding to the upper portion of the lower leg, a pressing force applied to the lower portion of the lower leg and a pressing force applied to the upper portion of the lower leg are equalized and thus the massaging effect for each portion of the lower leg can be equalized.

The massaging apparatus for the lower leg described thus far can be used as a single unit massager that is placed on the floor or on the bed, and as a footrest for the chair type massaging apparatus.

In other words, the chair type massaging apparatus of the present invention comprises a seat portion for supporting the hip of a human body from below, a seat back portion connected to the rear end of the seat, and a footrest mounted in front of the seat portion and having a massager for the lower leg. The footrest may be connected to the front end of the seat so as to be detachable or integrally, or may be arranged separately from the front end of the seat portion.

BEST MODE FOR CARRYING OUT INVENTION

Figure 1:
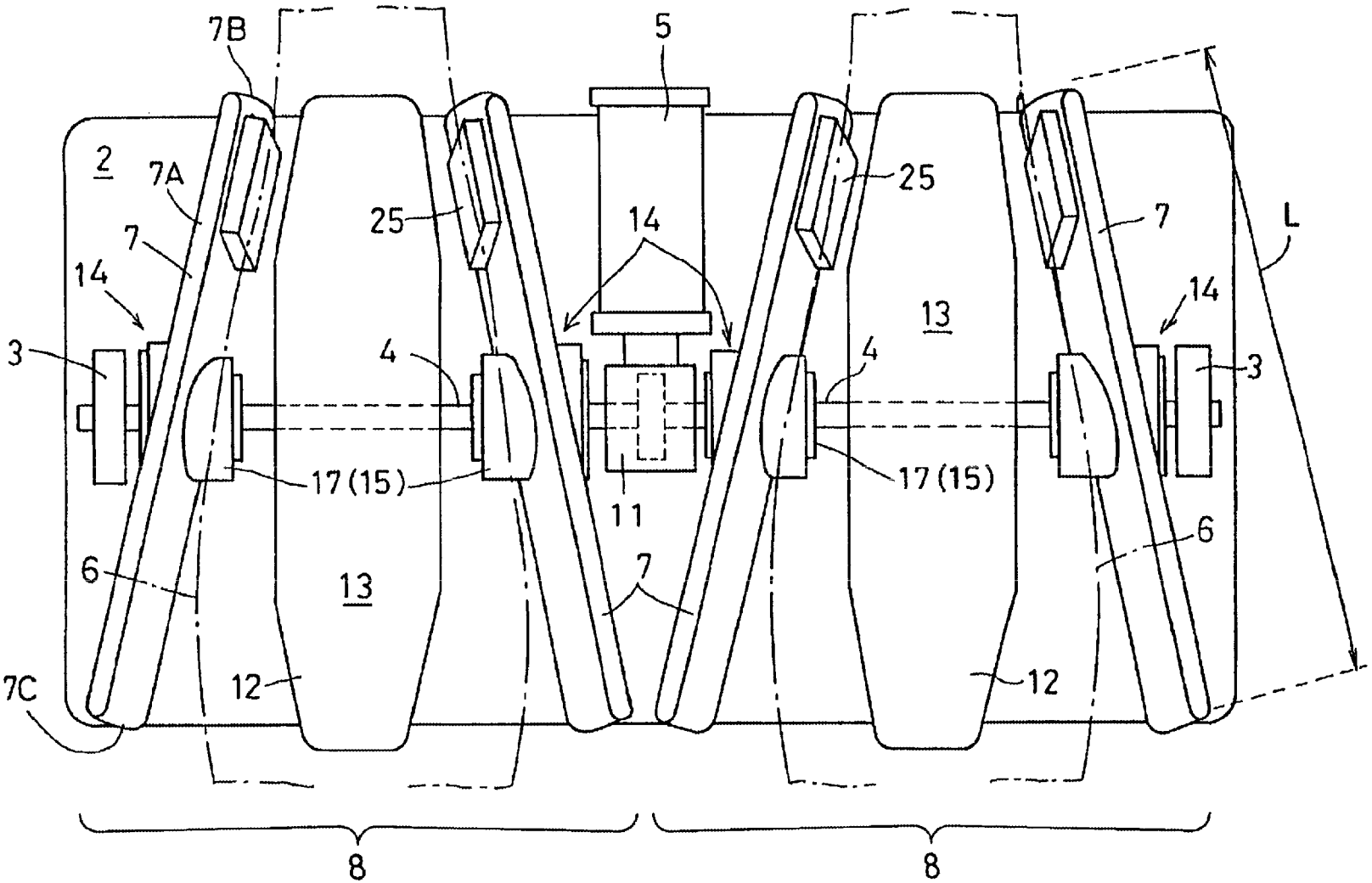
FIG. 1 is a plan view of a massager for lower legs.

Referring now to the drawings, the embodiment of the present invention will be described.

Figure 2:
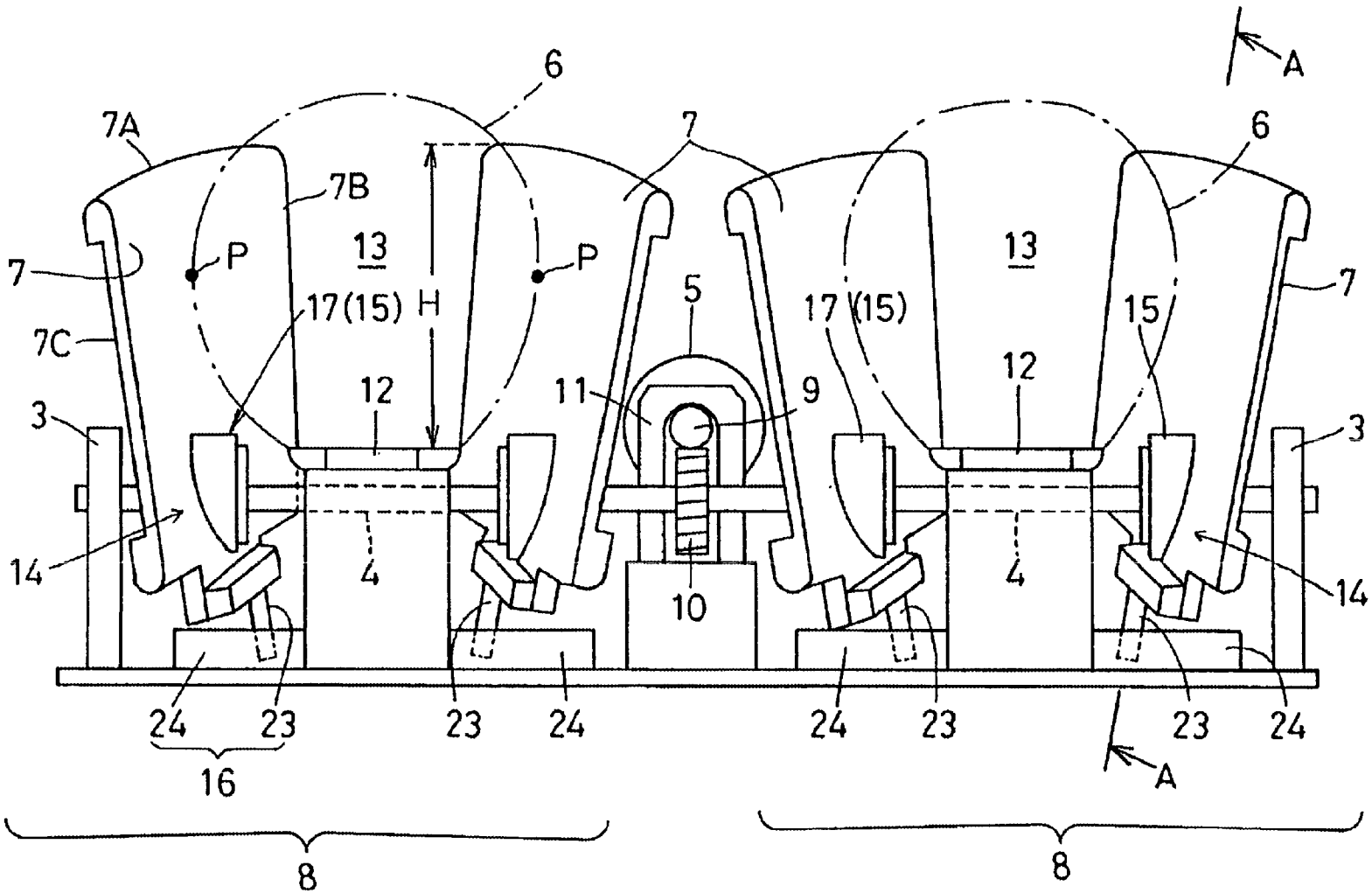
FIG. 2 is a front view of the massager for lower legs.

As shown in FIG. 1 and FIG. 2, a massager 1 for lower legs according to this embodiment comprises a base plate 2 formed generally in a laterally elongated rectangular shape, a revolving shaft 4 rotatably inserted between supporting brackets 3, 3 provided upright on both lateral ends of the base plate 2, a driving motor 5 for rotating the revolving shaft 4, and two massaging means 8, 8 each having a pair of right and left massaging members 7, 7 formed of board with inside surfaces S extending along the length of a human lower leg 6.

The base plate 2 is formed of a board of which the lateral length is approximately two times the vertical length, and provided with the supporting brackets 3, 3 at both ends on the right and left sides. The revolving shaft 4 is arranged along the longitudinal center line of the plate 2 in such a manner that the axial direction thereof coincides with the longitudinal direction (lateral direction in FIG. 1) of base plate 2, and both ends of the revolving shaft 4 in the axial direction are rotatably inserted into the bearing (not shown) provided within the supporting brackets 3, 3.

The driving motor 5 comprises an electric motor being capable of rotating in the forward and reverse directions, and is disposed at the lengthwise center of the base plate 2 between two massaging means 8, 8. The driving shaft of the driving motor 5 is fitted with a worm gear 9, which in turn engages the worm wheel 10 fixed at the lengthwise center of the revolving shaft 4, and these gear 9 and the wheel 10 are stored within the gear case 11 provided at the center of the base plate 2. Therefore, by rotating the driving motor 5 in the forward and reverse directions, the revolving shaft 4 can be rotated in the forward and reverse directions via the driving mechanism comprising the gear 9 and the wheel 10.

Each of the right and left massaging means 8, 8 comprises a pair of right and left massaging members 7, 7 through which the revolving shaft 4 is passed at the center thereof for relative rotation, and a leg mount 12 for supporting the lower leg 6 from below. The respective massaging members 7, 7 are arranged in a opposed manner at a space as wide as a lower leg 6 can be fitted therebetween, and formed of board with inside surfaces S elongated in the direction along the length of the lower leg 6.

As shown in FIG. 1, each massaging member 7, 7 has a longitudinal length L extending from the lower knee region to the portion near the ankle of the lower leg 6. As shown in FIG. 2, the widthwise dimension of each massaging member 7, 7 is set in such a manner that the height H from the upper surface of the leg mount 12 (bottom surface of a therapeutic recess 13) to the upper edge of the massaging member 7, 7 is higher than the thickest point P of the lower leg 6. In this manner, these pair of right and left massaging members 7, 7 and the leg mount 12 define the therapeutic recess 13 in the shape of an elongated groove, which can accommodate the portion of the lower leg 6 below the knee tightly and is extending in the direction along the length of the lower leg 6.

The two massaging means 8, 8 are arranged between the gear case 11 and the left supporting bracket 3, and between the same gear case 11 and the right supporting bracket 3 respectively at a space from side to side so that the therapeutic recesses 13 face toward the same direction.

The lower leg massager 1 of this embodiment comprises a driving means 14 for moving each massaging member 7, 7 toward and away from each other in such a manner that the extent of inclination of each massaging member 7, 7 with respect to the direction longitudinally along the lower leg 6 changes. The driving means 14 comprises the revolving shaft 4, a pair of right and left cam members 15, 15 fixed at axially intermediate positions of the revolving shaft 4, and guide members 16, 16 for allowing the massaging members 7, 7 to move along the revolving shaft 4 but restricting the same from being rotated therewith.

As shown in FIG. 1 and FIG. 2, the revolving shaft 4 passes through each massaging member 7, 7 in the direction of thickness at the center in the longitudinal direction and lower position in the widthwise direction thereof so as to be capable of relative rotation with respect to each massaging member 7, 7, and the cam members 15, 15 are provided at these through portions.

Figure 3:
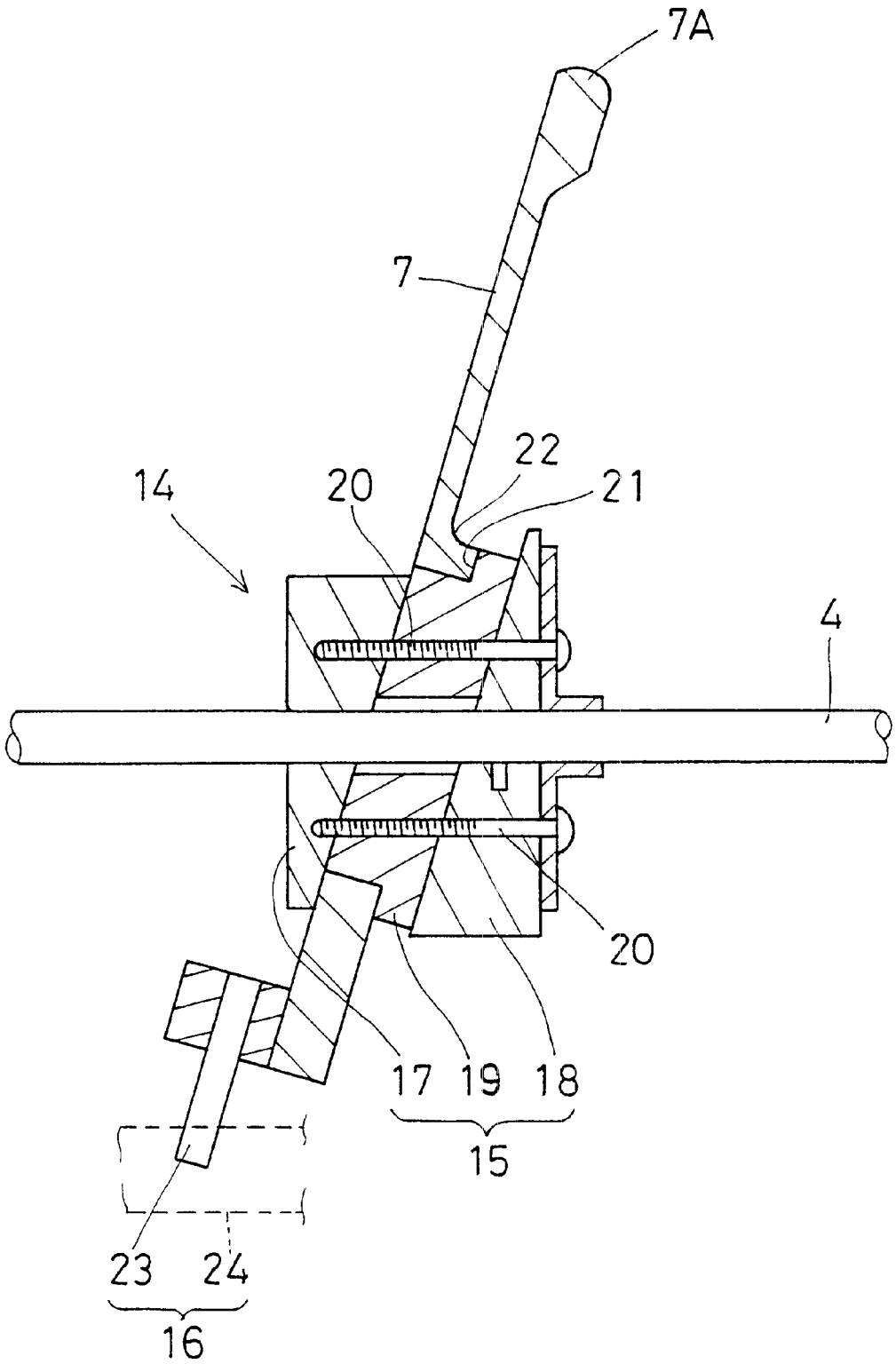
FIG. 3 is a cross sectional view taken along the line A—A in FIG. 2.

As shown in FIG. 3, the cam member 15 comprises a pair of front and back sandwiching plates 17, 18 each formed into a shape obtained by cutting a column diagonally with respect to the axis thereof, and a center plate 19 in the shape a short cylinder interposed between these sandwiching plates 17, 18, and these plates 17–19 are integrated into one piece with fixing screws 20 passing therethrough in the direction of the axis of the revolving shaft 4.

The sandwiching plates 17, 18 are fixed by a locking pin or the like, not shown, so as to move neither in the axial direction nor the rotating direction of the revolving shaft 4. On the other hand, the center plate 19 is fixed to both plates 17, 18 with the inclined surfaces of the sandwiching plates 18, 19 abutted against the front and back surfaces thereof. Therefore, the center plate 19 is arranged in a state in which the axis thereof is inclined with respect to the revolving shaft 4, so as to define a cam surface 21 inclined with respect to the revolving shaft 4 on the periphery thereof.

The center plate 19 is fitted within a boss portion 22 of the massaging member 7 so as to be capable of sliding movement, and in this case, the cam surface 21 of the center plate 19 abuts against the end surface of the boss portion 22. Therefore, the massaging member 7 is rotatably connected to the revolving shaft 4 in a state of being inclined with respect to the direction of the axis of the revolving shaft 4.

As shown in FIG. 1 and FIG. 2, the direction of inclination of the right and left cam members 15, 15 constituting one of massaging means 8 with respect to the revolving shaft 4 is set to be opposite with each other, whereby the pair of right and left massaging members 7, 7 move toward and away from each other by inclining their longitudinal directions in the opposite directions.

The guiding member 16 comprises a guide pin 23 projecting from the center of the lower edge of the massaging member 7 downwardly, and a guide rail 24 with which the guide pin 23 engages. As shown in FIG. 2, the guide rail 24 extends in the same direction as the revolving shaft 4 immediately under the revolving shaft 4 on the base plate 2 for guiding the projecting end of the guide pin 23 so as to be capable of moving in the axial direction of the revolving shaft 4 (lateral direction in FIG. 2) but not in the direction orthogonal to the axial direction.

Therefore, each massaging member 7, 7 is allowed to move along the revolving shaft 4 but is restricted from being rotated therewith by the guide pin 23 provided at the lower edge portion thereof.

On the other hand, as shown in FIG. 1, since a revolving shaft 4 passes through the pair of right and left massaging members 7, 7 at the lengthwise center thereof so that each massaging member 7, 7 moves toward and away from each other by the inclined cam surface 21 on the cam member 15 provided at the through portion thereof, the massaging members 7, 7 moves in such a manner that when one of the longitudinally opposing ends of the pair of right and left massaging members move toward each other, the other longitudinally opposing ends thereof move away from each other, and when one of the longitudinally opposing ends of the pair of right and left massaging members move away from each other, the other longitudinally opposing ends of the pair of right and left massaging members move toward each other.

Since the pair of right and left massaging members 7, 7 are restricted from being rotated with the revolving shaft 4 by the guide pin 23 and driven by the inclined cam surface 21 of the cam member 15 in this state, the extent of longitudinal inclination of the massaging members 7, 7 with respect to the direction of the length of the lower leg 6 (vertical direction in FIG. 1) changes sequentially and the extent of widthwise inclination thereof with respect to the direction of thickness of the lower leg 6 (vertical direction in FIG. 2) sequentially changes as well when the massaging member 7, 7 moves toward and away from each other.

On the other hand, since the massaging member 7 of this embodiment is formed of a plastic leaf spring that is resiliently deformable in the direction of thickness, the massaging members 7 are prevented from pressing the lower leg too strong and making the user feel pain.

As shown in FIG. 1, the portions of the pressing surfaces of the pair of right and left massaging members 7, 7 corresponding to the portions near the ankles of the lower leg 6 is fixed with a cushion material 25 formed of urethane foam resin or the like, whereby a pressing force of the massaging member 7 is appropriately applied to the relatively thin portion of the lower leg near the ankle. Therefore, a pressing force applied to the lower portion and to the upper portion of the lower leg 7 is equalized, and thus the massaging effect for each portion of the lower leg 6 can be equalized.

It is also possible to form the pressing surface of the massaging member 7 into a configuration suited to the curved configuration of the lower leg 6 without providing cushion material so that the portion of the massaging member 7 corresponding to the lower side of the lower leg 6 placed between both massaging members 7, 7 is moved closer to the lower leg 6 than the portion corresponding to the upper portion of the lower leg 6.

The operation of the lower leg massager 1 of this embodiment will now be described.

In order to massage the lower leg 6 of a person with this massager 1, both of the lower legs 6 of the person are placed between the pair of right and left massaging members 7, 7 of the respective massaging means 8, 8 (within the therapeutic recesses 13), and the driving motor 5 is actuated to move the massaging members 7, 7 toward and away from each other by the driving means 14. In this case, each massaging member 7, 7 moves toward and away from each other in a state where the longitudinal directions thereof are inclined in the direction opposed with respect to each other for massaging the lower leg 6 fitted therebetween.

Figure 4A:
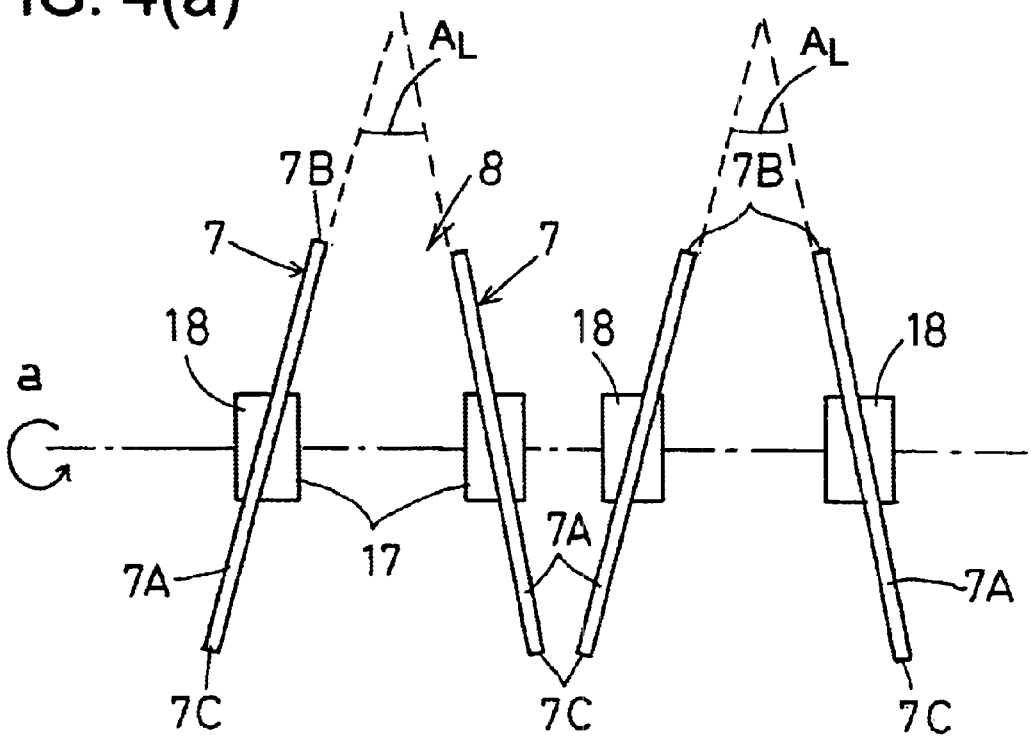
FIGS. 4(*a*) and (*b*) are plan views showing a massaging operation made by massaging means.
Figure 4B:
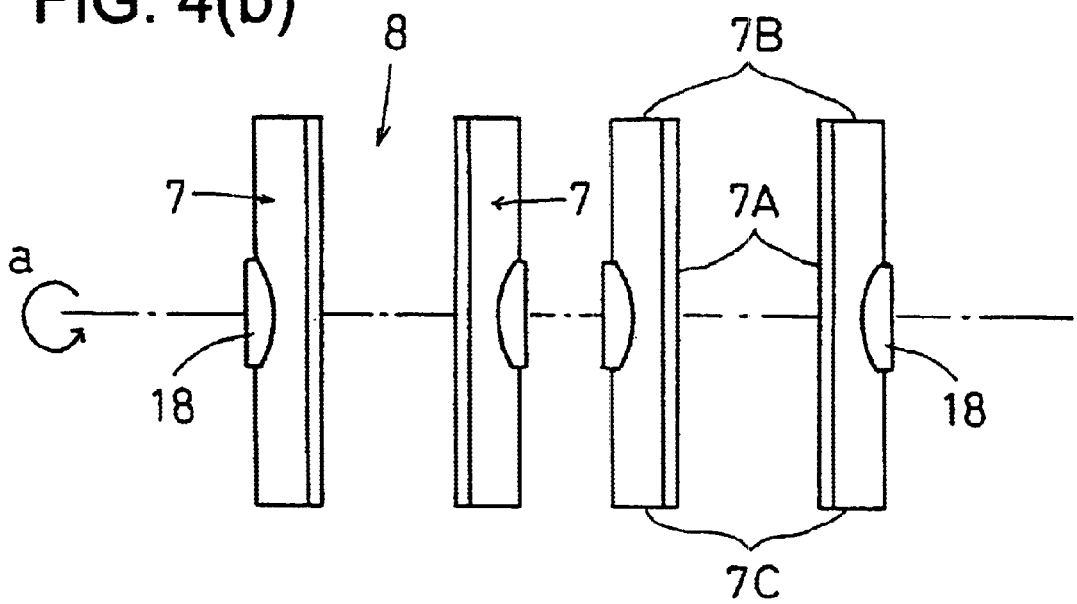

FIGS. 4 to 7 show the massaging action made by the massaging means 8 in the case described above. FIGS. 4(*a*), (*b*) and FIGS. 5(*a*), (*b*) are plan views showing the action of the respective massaging means 8, 8 in association with change over time, and FIGS. 6(*a*), (*b*) and 7(*a*), (*b*) are front views corresponding to FIGS. 4(*a*), (*b*) and FIGS. 5(*a*), (*b*). FIG. 4(*a*) shows inside surfaces S having a lengthwise inclined angle ($A_L$) therebetween, and FIG. 6(*b*) shows inside surfaces S having a widthwise inclined angle ($A_w$) therebetween.

Figure 5A:
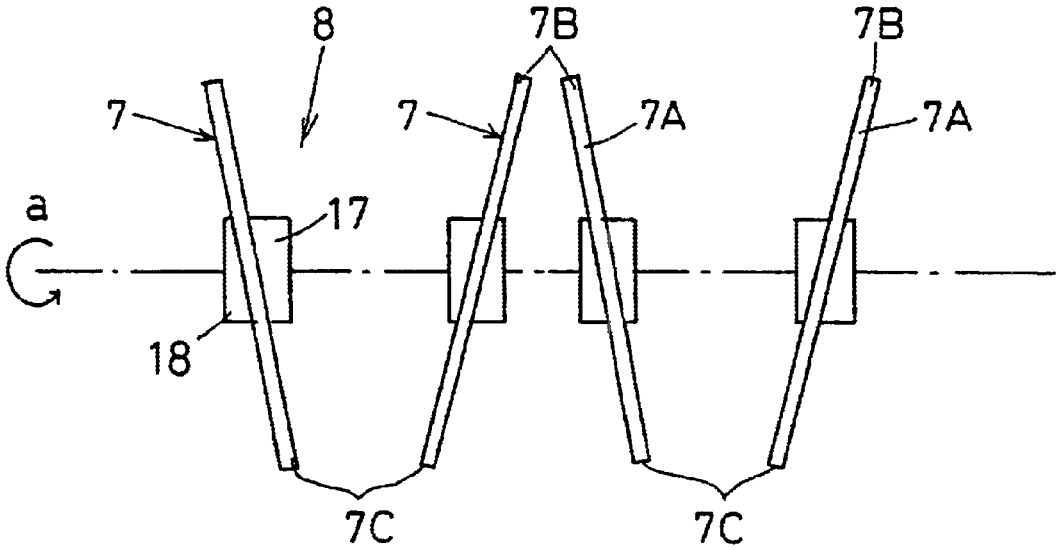
FIGS. 5(*a*) and (*b*) are plan views showing a massaging operation made by massaging means.
Figure 5B:
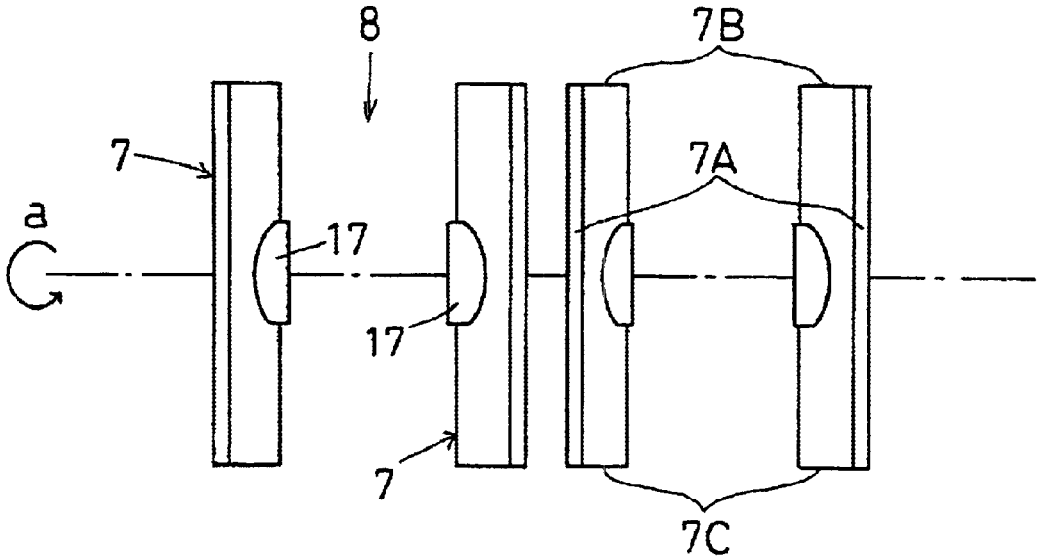
Figure 6A:
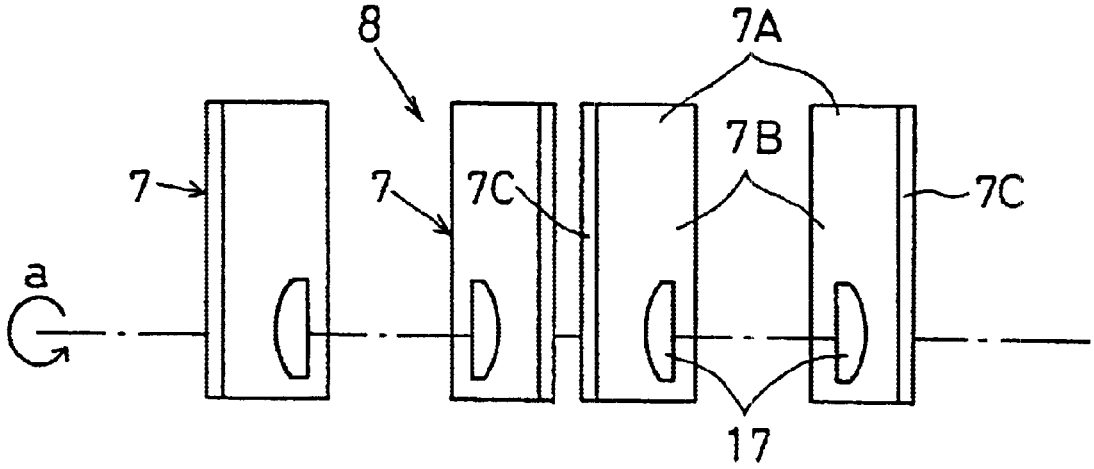
FIGS. 6(*a*) and (*b*) are front views showing a massaging operation made by massaging means.
Figure 6B:
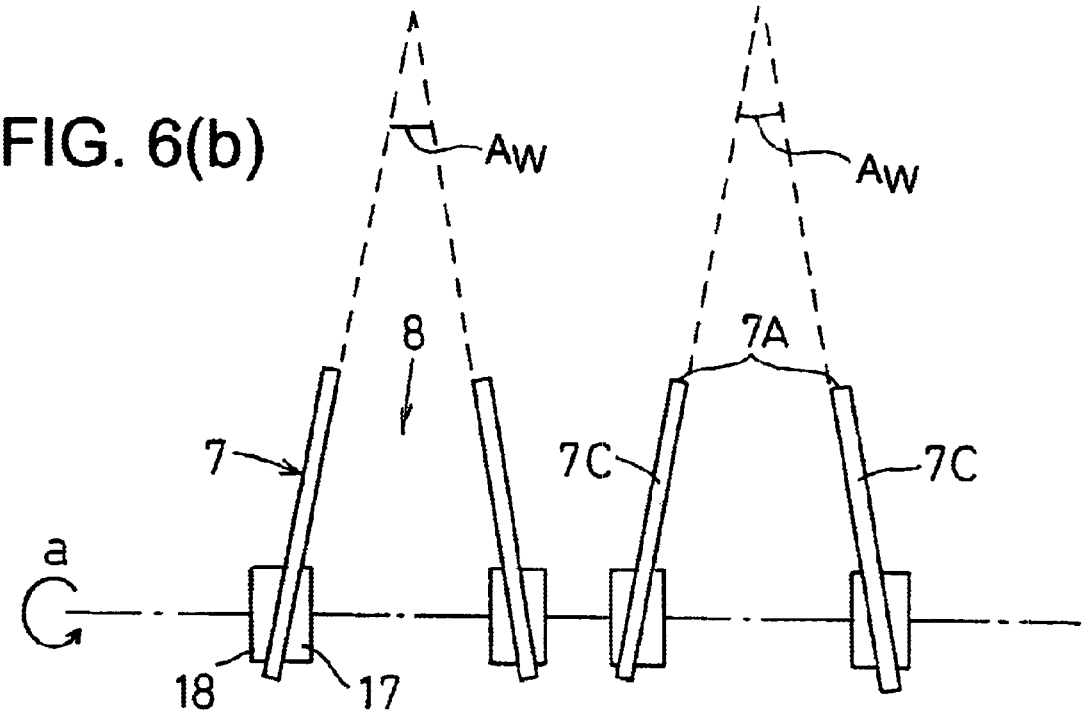

In other words, FIG. 4(*b*) shows a state in which the revolving shaft 4 rotates one-quarter turn from the state shown in FIG. 4(*a*), FIG. 5(*a*) shows a state in which the revolving shaft 4 rotates two-quarters turn from the state shown in FIG. 4(*a*), and FIG. 5(*b*) shows a state in which the revolving shaft 4 rotates three-quarters from the state shown in FIG. 4(*a*). FIGS. 6(*a*), (*b*) and FIGS. 7(*a*), (*b*) are front views corresponding to FIGS. 4(*a*), (*b*), and FIGS. 5(*a*), (*b*), respectively.

As shown in FIG. 4(*a*), the widthwisely extending upper edges 7A of the respective massaging members 7, 7 incline in the opposite direction with respect to the revolving shaft 4 so that the ends on one side of the edges 7A take the closest position and the ends on the other side thereof take the farthest position, and as shown in FIG. 6(*a*), one longitudinally extending edge 7B and the other longitudinally extending edge 7C of each massaging member 7, 7 are perpendicular to the revolving shaft 4.

When the revolving shaft 4 rotates one-quarter turn in the direction as shown in the figure from the state shown in FIG. 4(*a*) and FIG. 6(*a*), the widthwisely extending upper edges 7A of the respective massaging members 7, 7 move closer in parallel with each other so as to be perpendicular to the revolving shaft 4, and as shown in FIG. 6(*b*), the one longitudinally widthwise extending edge 7B and the other longitudinally extending edge 7C of each massaging member 7, 7 incline to a state in which the upper edges 7A thereof take the position closest with respect to each other.

Figure 7A:
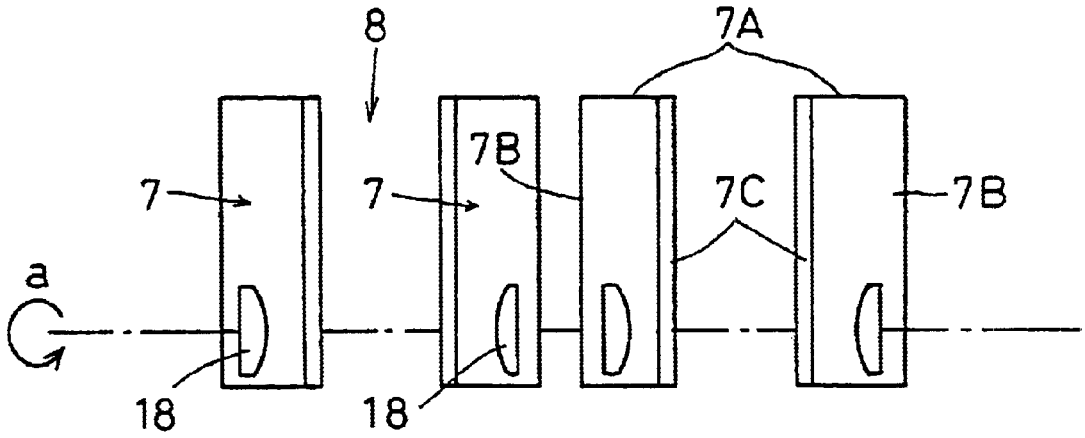
FIGS. 7(*a*) and (*b*) are front views showing a massaging operation made by massaging means.
Figure 7B:
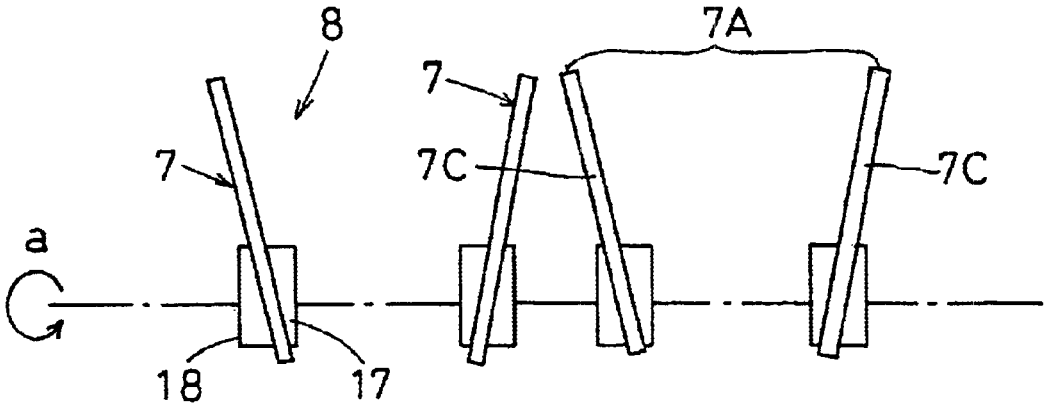

When the revolving shaft 4 further rotates one-quarter turn from the state shown in FIG. 4(*b*) and FIG. 6(*b*), as shown in FIG. 5(*a*), the widthwisely extending upper edges 7A of the respective massaging members 7, 7 incline in the opposite direction with respect to the revolving shaft 4 so that the ends on one side thereof take the farthest position and the ends on the other side thereof take the closest position, and as shown in FIG. 7(*a*), one longitudinally extending edge 7B and the other longitudinally extending edge 7C of each massaging member 7, 7 are perpendicular to the revolving shaft 4.

When the revolving shaft 4 further rotates one-quarter turn from the state shown in FIG. 5(*a*) and FIG. 7(*a*) as shown in FIG. 5(*b*), the widthwisely extending upper edges 7A of the respective massaging members 7, 7 move away in parallel with each other so as to be perpendicular to the revolving shaft 4, and as shown in FIG. 7(*b*), the one longitudinally extending edge 7B and the other longitudinally extending edge 7C of each massaging member 7, 7 incline to a state in which the upper edges 7A thereof take the position farthest with respect to each other.

Then, when the revolving shaft 4 further rotates one-quarter turn from the state shown in FIG. 5(*b*) and FIG. 7(*b*), the massaging members 7, 7 return to the original state shown in FIG. 4(*a*) and FIG. 6(*a*).

As is described thus far, according to the lower leg massager 1 of this embodiment, a pair of right and left massaging members 7, 7 each formed into elongated board extending along the length of the lower leg 6 not only moves in parallel toward the lower leg 6, but also changes the extent of inclination in the longitudinal direction with respect to the length of the lower leg 6 when moving toward and away from each other, and thus the massaging member 7 adequately presses each portions of the lower leg 6 having different thickness along the length thereof.

Therefore, a single massaging member 7 can adequately massage over a wide range of the lower leg 6 along the length thereof without providing a plurality of massaging members along the length of the lower leg 6. Since the extent of inclination of each massaging member 7, 7 in the longitudinal direction thereof with respect to the longitudinal direction of the lower leg 6 changes when the respective massaging members 7, 7 move toward and away from each other, complex massaging operation such as rubbing up and rubbing down for the lower leg 6 can be performed.

Since the pair of right and left massaging members 7, 7 are constructed in such a manner that when the longitudinally opposing ends on one side of the pair of right and left massaging members 7, 7 move toward each other, the other longitudinally opposing ends thereof move away from each other, and when one of the longitudinally opposing ends of the pair of right and left massaging members move away from each other, the other ends of the pair of right and left massaging members move toward each other (See FIG. 4(*a*) and FIG. 5(*c*)), the therapeutic portions of the lower leg 6 longitudinally away from each other can be massaged alternately at different timings by the longitudinally opposing ends of the pair of right and left massaging members 7, 7, which also improves the massaging effect for the lower leg 6.

In addition, since the extent of widthwise inclination with respect to the direction of thickness of the lower leg 6 also changes with the movement of both of the massaging members 7, 7 toward and away from each other, the complex massaging operation such as rubbing up and rubbing down with respect to the lower leg 6 can also be performed in the direction of thickness thereof.

Figure 8A:
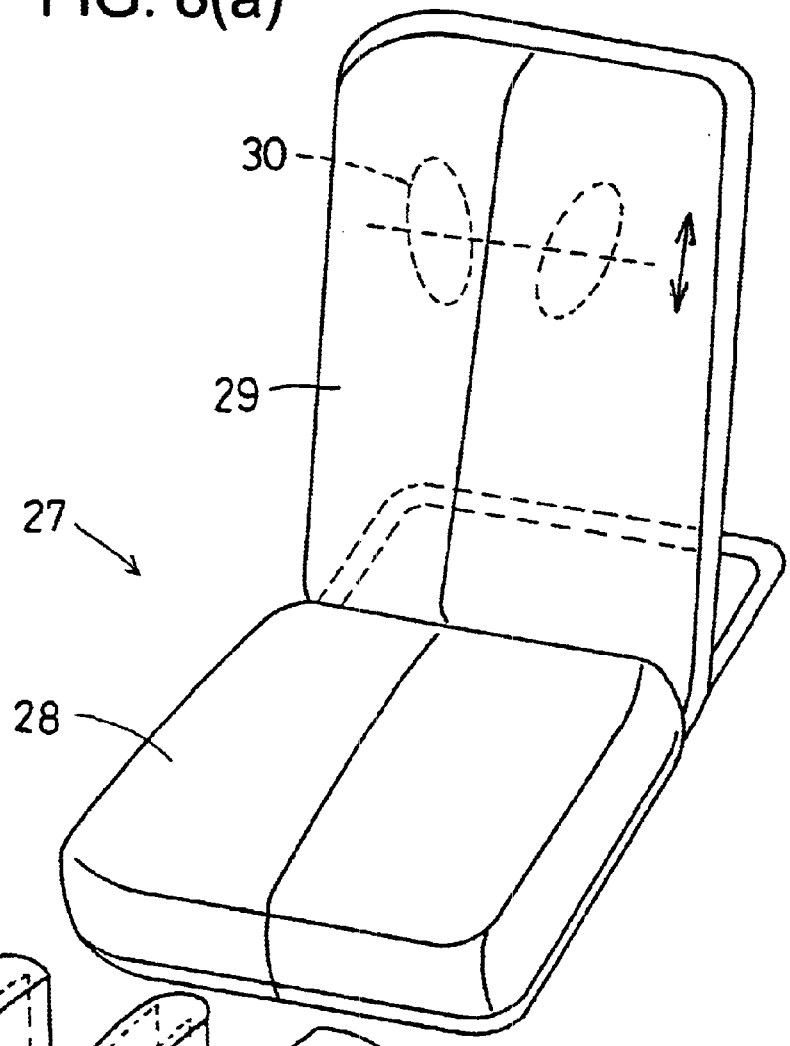
FIG. 8(*a*) is a perspective view of a legless chair type massaging apparatus, and FIG. 8(*b*) is a perspective view of a footrest with a leg massager.
Figure 8B:
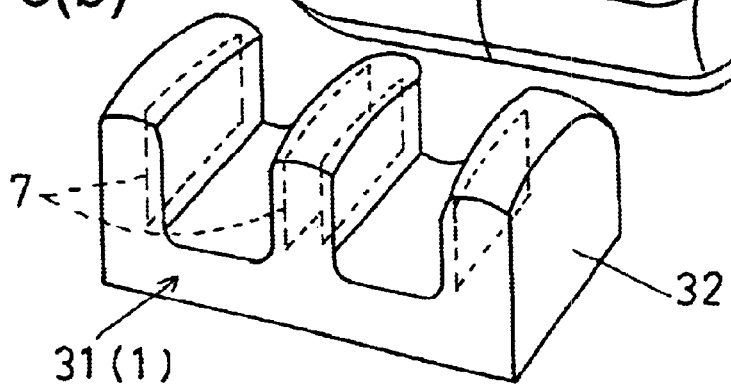
Figure 9:
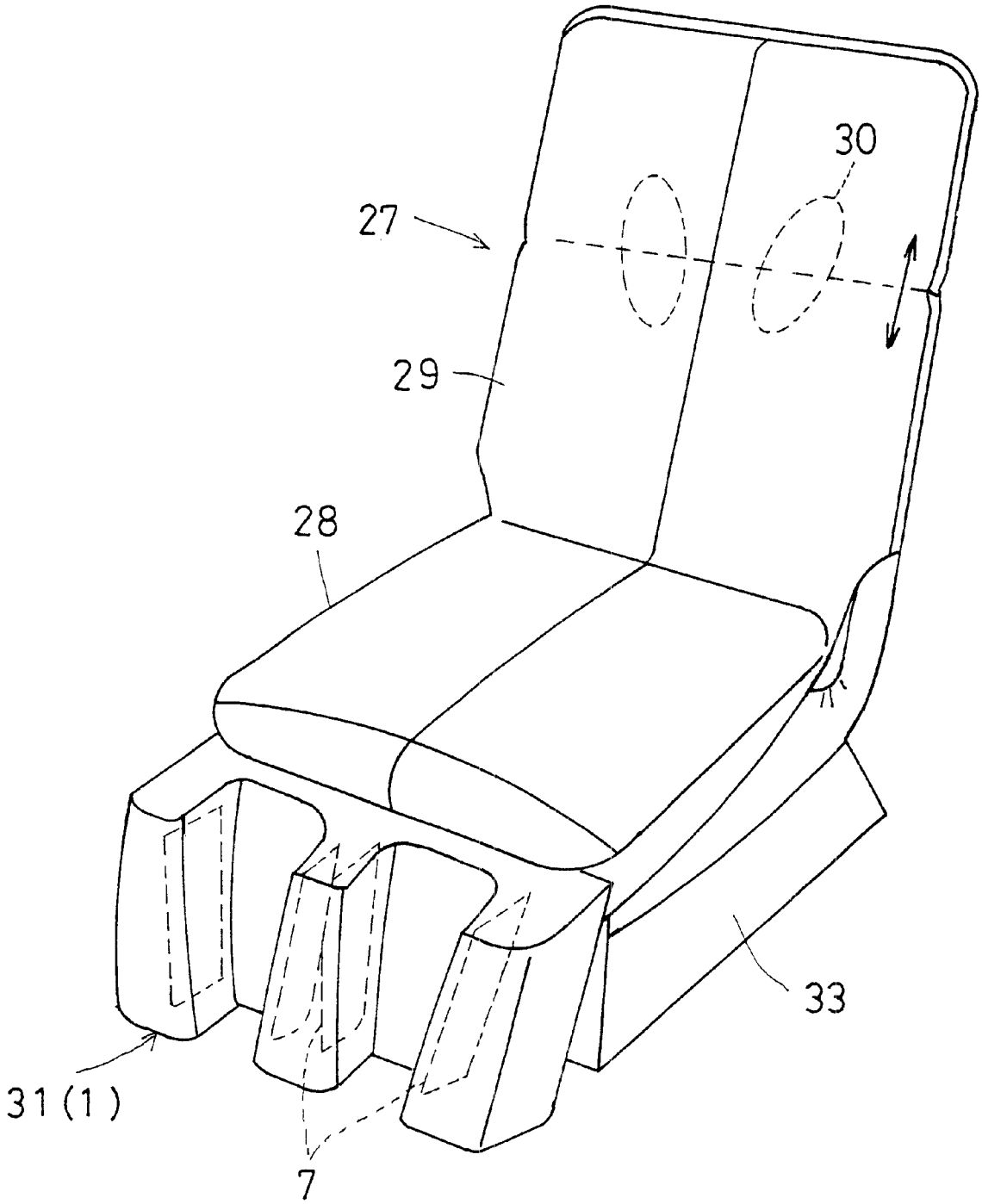
FIG. 9 is a perspective view of a normal chair type massaging apparatus.

FIG. 8(*a*) and FIG. 9 show specific examples of a chair type massaging apparatus 27 using the lower leg massager 1 described above.

FIG. 8(*a*) shows a legless chair type massaging apparatus 27 in which a seat portion 28 is placed directly on the floor comprising: the seat portion 28 for supporting the hip of a human body from below, and a seatback portion 29 connected to the rear end portion of the seat portion 28. In the seatback portion 29, there is provided a massaging mechanism 30 for performing rubbing or tapping massage incorporated therein so as to be capable of moving vertically, and in the seat portion 28 there is provided a reclining mechanism (not shown) for changing the angle of inclination of the seatback portion 29.

As shown FIG. 8(*b*), a footrest 31 is disposed forwardly of the seat portion 28, and the footrest 31 is constructed by covering the entire lower leg massager 1 with a covering member 32 such as a raised cloth or the like.

According to the chair-type massaging apparatus 27, the user can be given a massage on his/her back or neck by the massaging mechanism 30 provided in the seatback portion 29 while sitting on the seat portion 28, and simultaneously on his/her lower legs 6 (especially on his/her calves) by the footrest 31 incorporated in the massager 1 arranged forwardly of the seat portion 28.

The footrest 31 (lower leg massager 1) described above may be detachably connected to the seat portion 28. The footrest 31 described above may also be used as a single massager that is used separately from the legless chair 27 by placing on the floor or on the bed.

FIG. 9 shows a normal chair type massaging apparatus 27 in which a seat portion 28 is arranged at a higher position away from the floor, comprising the seat portion 28 for supporting the hip of a human body from below, a leg portion 33 for supporting the seat portion 28 form below, and a seatback portion 29 connected to the rear end of the seat portion 28. The seatback portion 29 is provided with a massaging mechanism 30 incorporated therein so as to be capable of vertical movement, and in the seat portion 28 there is provided a reclining mechanism (not shown) for changing the angle of inclination of the seatback portion 29.

The front end portion of the seat portion 28 is connected with a footrest 31 including the lower leg massager 1 incorporated therein so as to be capable of vertical swinging movement, and the angle of inclination of the footrest 31 with respect to the seat portion 28 can be changed corresponding to the angle of inclination of the seatback portion 29.

The embodiments shown in this specification is illustrative but not restrictive. The scope of the present invention is defined by appended claims, and all the modifications containing these respective claims are included in the present invention. For example, the present invention may comprise only a single massaging means 8.

As is described thus far, according to the present invention, since a wide range of the lower leg along the length thereof can be pressed by a pair of right and left massaging member, it is not necessary to provide a plurality of massaging member along the length of the lower leg, whereby a massager that can adequately massage the lower leg over a wide range can be provided at low cost.

INDUSTRIAL APPLICABILITY

The present invention is directed to a massager that is suitable for massaging the lower leg of a human body. Therefore, the present invention can be used for the product that massages only the lower leg. The present invention can also be used as a component of a chair type massaging apparatus by incorporating it within a footrest provided forwardly of a seat portion of the chair type massaging apparatus.

What is claimed is:

1. A lower leg massager comprising:

a massaging device for massaging a lower leg, the massaging device having a right and a left massaging member each formed of an elongated board having a predetermined length and a predetermined width, the right and left massaging members each having an inside surface bounded by the lengths and width thereof, the inside surfaces opposing each other at a predetermined distance to create a therapeutic recess for enclosing the lower leg, the inside surfaces having a lengthwise inclined angle therebetween, and also a widthwise inclined angle therebetween; and a driving device for moving the right and the left members toward and away from each other so that the lengthwise inclined angle changes to an opposite lengthwise inclined angle, the extent of the widthwise inclined angle also changing when the right and the left members move toward and away from each other, wherein the right and the left massaging members are formed of leaf springs that are resiliently deformable in a direction of thickness.

2. The lower leg massager as set forth in claim 1, wherein the driving device drives the right and left massaging members in such a manner that when longitudinally opposing ends at one end of the massaging members move toward each other, longitudinally opposing ends at an opposite end thereof move away from each other, and when the longitudinally opposing ends at the one end move away from each other, the longitudinally opposing ends at the opposite end move to ward each other.

3. The lower leg massager as set forth in claim 1, wherein the driving device changes the extent of the widthwise inclined angle of the right and the left massaging members with respect to the lower leg when the massaging members are moved toward and away from each other.

4. The lower leg massager as set forth in claim 1, wherein the driving device comprises:

a revolving shaft passing through the right and the left massaging members in a thicknesswise direction so as to be capable of relative rotation with respect to the right and the left massaging members;

a right and a left cam member fixed at axially intermediate positions of the revolving shaft, the right cam member having a cam surface inclined with respect to the revolving shaft and abutted against the right massaging member, and the left cam member having a cam surface inclined with respect to the revolving shaft and abutted against the left massaging member; and a guide member for allowing the right and left massaging members to move longitudinally with respect to the revolving shaft but restricting a rotation with respect to the revolving shaft.

5. The lower leg massager as set forth in claim 1, wherein two massaging devices are arranged side by side and parallel to and separate from each other in such a manner that the therapeutic recess of one massaging means encloses a right lower leg, and the therapeutic recess of the other massaging means encloses a left lower leg.

6. The lower leg massager as set forth in claim 5, wherein a driving motor for rotating the revolving shaft is disposed between the two massaging devices.

7. The lower leg massager as set forth in claim 1, wherein the left and right massaging members are constructed in such a manner that longitudinally opposing ends at one end of the massaging members are moved closer to each other than longitudinally opposing ends at an opposite end of the massaging members, the longitudinally opposing ends that are moved closer to each other are provided for fitting around a lower portion of the lower leg.

8. A chair type massaging apparatus comprising:

a seat portion for supporting a hip of a human body; a seatback portion connected to a rear end of the seat portion; and a footrest having a lower leg massager, the lower leg massager comprising:

a massaging device for massaging a lower leg, the massaging device having a right and a left massaging member each formed of an elongated board having a predetermined length and a predetermined width, the right and left massaging members each having an inside surface bounded by the lengths and width thereof, the inside surfaces opposing each other at a predetermined distance to create a therapeutic recess for enclosing the lower leg, the inside surfaces having a lengthwise inclined angle therebetween, and also a widthwise inclined angle therebetween; and a driving device for moving the right and the left members toward and away from each other so that the lengthwise inclined angle changes to an opposite lengthwise inclined angle, the extent of the widthwise inclined angle also changing when the right and the left members move toward and away from each other, wherein the driving device comprises:

a revolving shaft passing through the right and the left massaging members in a thicknesswise direction so as to be capable of relative rotation with respect to the right and the left massaging members;

a right and a left cam member fixed at axially intermediate positions of the revolving shaft, the right cam member having a cam surface inclined with respect to the revolving shaft and abutted against the right massaging member, and the left cam member having a cam surface inclined with respect to the revolving shaft and abutted against the left massaging member; and a guide member for allowing the right and left massaging members to move longitudinally with respect to the revolving shaft but restricting a rotation with respect to the revolving shaft.

9. A lower leg massager comprising:

a massaging device for massaging a lower leg, the massaging device having a right and a left massaging member each formed of an elongated board having a predetermined length and a predetermined width, the right and left massaging members each having an inside surface bounded by the lengths and width thereof, the inside surfaces opposing each other at a predetermined distance to create a therapeutic recess for enclosing the lower leg, the inside surfaces having a lengthwise inclined angle therebetween, and also a widthwise inclined angle therebetween;

a driving device for moving the right and the left members toward and away from each other so that the lengthwise inclined angle changes to an opposite lengthwise inclined angle, the extent of the widthwise inclined angle also changing when the right and the left members move toward and away from each other, wherein the driving device comprises:

a revolving shaft passing through the right and the left massaging members in a thicknesswise direction so as to be capable of relative rotation with respect to the right and the left massaging members;

a right and a left cam member fixed at axially intermediate positions of the revolving shaft, the right cam member having a cam surface inclined with respect to the revolving shaft and abutted against the right massaging member, and the left cam member having a cam surface inclined with respect to the revolving shaft and abutted against the left massaging member; and a guide member for allowing the right and left massaging members to move longitudinally with respect to the revolving shaft but restricting a rotation with respect to the revolving shaft.

10. The lower leg massager as set forth in claim 9, wherein the driving device drives the right and left massaging members in such a manner that when longitudinally opposing ends at one end of the massaging members move toward each other, longitudinally opposing ends at an opposite end thereof move away from each other, and when the longitudinally opposing ends at the one end move away from each other, the longitudinally opposing ends at the opposite end move toward each other.

11. The lower leg massager as set forth in claim 9, wherein the driving device changes the extent of the widthwise inclined angle of the right and the left massaging members with respect to the lower leg when the massaging members are moved toward and away from each other.

12. The lower leg massager as set forth in claim 9, wherein two massaging devices are arranged side by side and parallel to and separate from each other in such a manner that the therapeutic recess of one massaging means encloses a right lower leg, and the therapeutic recess of the other massaging means encloses a left lower leg.

13. The lower leg massager as set forth in claim 12, wherein a driving motor for rotating the revolving shaft is disposed between the two massaging devices.

14. A lower leg massager as set forth in claim 9, wherein the pair of right and left massaging members are formed of leaf springs that are resiliently deformable in the direction on thickness.

15. The lower leg massager as set forth in claim 9, wherein the left and right massaging members are constructed in such a manner that longitudinally opposing ends at one end of the massaging members are moved closer to each other than longitudinally opposing ends at an opposite end of the massaging members, the longitudinally opposing ends that are moved closer to each other are provided for fitting around a lower portion of the lower leg.

* * * * *

US006629940C1

(12) EX PARTE REEXAMINATION CERTIFICATE (6952nd)

United States Patent

Shimizo

(10) Number: US 6,629,940 C1

(45) Certificate Issued: Jul. 21, 2009

(54) LOWER LEG MASSAGER AND CHAIR TYPE MASSAGING APPARATUS USING THE SAME

(75) Inventor: Nobuzo Shimizo, Higashi-Osaka (JP)

(73) Assignee: Daito Electric Machine Industry Company Limited, Higashi-Osaka-shi, Osaka (JP)

Reexamination Request:
No. 90/009,047, Feb. 19, 2008

Reexamination Certificate for:

| | |
|---|---|
| Patent No.: | **6,629,940** |
| Issued: | **Oct. 7, 2003** |
| Appl. No.: | **09/958,033** |
| Filed: | **Oct. 3, 2001** |

(22) PCT Filed: Mar. 21, 2001

(86) PCT No.: PCT/JP01/02268

§ 371 (c)(1),
(2), (4) Date: Oct. 3, 2001

(87) PCT Pub. No.: WO01/76527

PCT Pub. Date: Oct. 18, 2001

(30) Foreign Application Priority Data

Apr. 6, 2000 (JP) ..... 2000-105143

(51) Int. Cl.
*A61H 7/00* (2006.01)

(52) U.S. Cl. ..... 601/133; 601/97; 601/101

(58) Field of Classification Search ..... None
See application file for complete search history.

(56) References Cited

U.S. PATENT DOCUMENTS

| | | | | |
|---|---|---|---|---|
| 3,633,571 | A | | 1/1972 | Shinagawa et al. |
| 4,505,267 | A | | 3/1985 | Inada et al. |
| 4,936,292 | A | | 6/1990 | Hidetsugu et al. |
| 5,445,595 | A | | 8/1995 | Chou |
| 5,762,618 | A | * | 6/1998 | Yamanaka et al. ..... 601/148 |
| 5,772,615 | A | | 6/1998 | Elder et al. |
| 5,827,205 | A | | 10/1998 | Iwamoto et al. |
| 5,830,161 | A | | 11/1998 | Cosmano |
| 6,629,940 | B2 | | 10/2003 | Shimizu et al. |

FOREIGN PATENT DOCUMENTS

| | | | | |
|---|---|---|---|---|
| CN | 2346429 | Y | | 11/1999 |
| CN | 1240126 | A | | 1/2000 |
| DE | 34 17 532 | A1 | | 11/1985 |
| EP | 1 000 600 | A1 | | 5/2000 |
| JP | 50-86889 | | | 7/1975 |
| JP | 52-84892 | | | 7/1977 |
| JP | 56-119251 | A | | 9/1981 |
| JP | 58-145634 | U | | 9/1983 |
| JP | 2-109628 | U | | 9/1990 |
| JP | H5-7610 | | * | 1/1993 |
| JP | 05-15560 | A | | 1/1993 |
| JP | H5-42187 | | * | 2/1993 |
| JP | 5-37237 | U | | 5/1993 |
| JP | 06-54885 | A | | 3/1994 |
| JP | 07-323065 | A | | 12/1995 |
| JP | 8-89540 | A | | 4/1996 |
| JP | 10-118143 | A | | 5/1998 |
| JP | 10-263030 | A | | 10/1998 |
| JP | 10-295753 | A | | 11/1998 |
| JP | 11-4859 | A | | 1/1999 |
| JP | H11-4860 | | * | 1/1999 |
| JP | 11-9636 | A | | 1/1999 |
| JP | 11-206829 | A | | 8/1999 |
| JP | 11-206830 | A | | 8/1999 |
| JP | 3012780 | B2 | | 12/1999 |

(Continued)

*Primary Examiner*—Joseph A. Kaufman

(57) ABSTRACT

A lower leg massager is constructed in such a manner that the lower leg can be massaged over a wide range without arranging a plurality of massaging members along the length thereof. Right and left massaging members formed of elongated boards are arranged in an opposed manner so a lower leg can be fit therebetween. A driving mechanism is provided for moving the massaging members toward and away from each other so that the longitudinal directions thereof are inclined in opposite directions with respect to each other, and changing the extent of longitudinal inclination when moving the massaging members toward and away from each other.

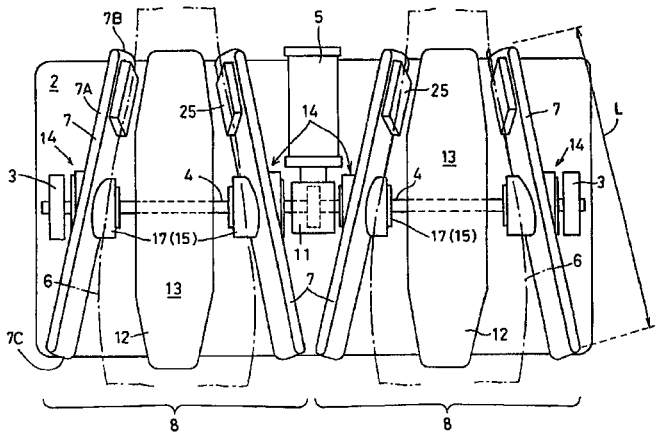

FOREIGN PATENT DOCUMENTS

| | | | |
|---|---|---|---|
| JP | 11-347082 | A | 12/1999 |
| JP | 2000-14733 | A | 1/2000 |
| JP | 2000-051301 | A | 2/2000 |
| JP | 2000-084020 | A | 3/2000 |
| JP | 2000-126263 | A | 5/2000 |
| KR | 10-0190594 | B1 | 1/1999 |
| KR | 20-0168891 | Y1 | 11/1999 |
| KR | 200174628 | Y | 3/2000 |
| TW | 403647 | B | 9/2000 |
| TW | 457944 | Y | 10/2001 |
| TW | 590769 | B | 6/2004 |
| WO | WO-99/56694 | A1 | 11/1999 |

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–15 is confirmed.

New claims 16–31 are added and determined to be patentable.

*16. The lower leg massager of claim 1, further comprising:*

*a leg mount, wherein the right and the left massaging members and the leg mount define the therapeutic recess having a shape of a groove for enclosing the lower leg.*

*17. The lower leg massager of claim 1, further comprising:*

*a leg mount provided between the right and the left massaging members, the leg mount supporting the lower leg, wherein the right and the left massaging members and the leg mount define the therapeutic recess.*

*18. The lower leg massager of claim 1, further comprising: a base plate on which the massaging device and the driving device are arranged.*

*19. The chair type massaging apparatus of claim 8, and wherein the right and left massaging members are formed of leaf springs that are resiliently deformable in a direction of thickness.*

*20. The chair type massaging apparatus of claim 8, wherein the elongated board has a substantially rectangular shape.*

*21. The lower leg massager of claim 9, wherein the elongated boards form a therapeutic recess for enclosing a substantial portion of the lower leg.*

*22. The chair type massaging apparatus of claim 8, wherein the driving device drives the right and left massaging members in such a manner that when longitudinally opposing ends at one end of the massaging members move toward each other, longitudinally opposing ends at an opposite end thereof move away from each other, and when the longitudinally opposing ends at the one end move away from each other, the longitudinally opposing ends at the opposite end move toward each other.*

*23. The chair type massaging apparatus of claim 8, wherein the driving device changes the extent of the widthwise inclined angle of the right and the left massaging members with respect to the lower leg when the massaging members are moved toward and away from each other.*

*24. The lower leg massager of claim 1, wherein the predetermined length of each elongated board massaging member is substantially coextensive with a length of the leg to be massaged.*

*25. The lower leg massager of claim 1, further comprising a leg rest having a structure substantially paralleling the therapeutic enclosure.*

*26. The lower leg massager of claim 1, further comprising a cushion provided to the inside surface of at least one massaging member.*

*27. The lower leg massager of claim 1, whrein the therapeutic recess is adapted to substantially enclose the lower leg.*

*28. The chair type massaging apparatus of claim 8, wherein the footrest encloses the therapeutic recess with an enclosure wherein the length of the footrest enclosure is substantially coextensive with a length of the leg to be massaged.*

*29. The lower leg massager of claim 1, wherein the elongated board has a substantially rectangular shape.*

*30. The chair type massaging apparatus of claim 8, wherein the footrest is adapted to be detachably connected to the leg massager.*

*31. The chair type massaging apparatus of claim 8, wherein the footrest is integrally connected to the leg massager.*

* * * * *